US006021656A

United States Patent [19]

Bogendörfer et al.

[11] Patent Number: 6,021,656

[45] Date of Patent: Feb. 8, 2000

[54] ROLL STAND WITHOUT HOUSINGS

[75] Inventors: Hans Bogendörfer; Hans-Jürgen Reismann, both of Düsseldorf, Germany

[73] Assignee: SMS Schloemann-Siemag Aktiengesellschaft, Düsseldorf, Germany

[21] Appl. No.: 09/196,550

[22] Filed: Nov. 20, 1998

[30] Foreign Application Priority Data

Nov. 27, 1997 [DE] Germany ..... 197 52 547

[51] Int. Cl.[7] ..... B21B 31/00; B21B 31/07

[52] U.S. Cl. ..... 72/237

[58] Field of Search ..... 72/240, 248, 237, 72/245, 238, 239, 464

[56] References Cited

U.S. PATENT DOCUMENTS 2,961,901 11/1960 Wheeler ..... 72/248

3,415,097 12/1968 Wheeler ..... 72/248

3,431,762 3/1969 O'Brien ..... 72/248

*Primary Examiner*—Rodney Butler

*Attorney, Agent, or Firm*—Friedrich Kueffner

[57] ABSTRACT

A roll stand without roll housings has at least two work rolls which are mounted in roll bearings and which each extend along a roll axis, wherein the rolls define a roll gap and the roll axes define a roll plane, so that the roll plane contains both roll axes, wherein the roll bearings are connected to each other through two groups of connecting elements, and wherein one group of connecting elements each is arranged on each side of the roll plane. The connecting elements of the groups are adjustable over an adjusting length distance, wherein at least one of the groups is adjustable under load by an adjustment drive in the adjusting direction over an under-load length distance and wherein the under-load length distance is substantially smaller than the adjusting length distance. With respect to the portion of the adjusting length distance which exceeds the under-load length distance, the groups of connecting elements are constructed so as to be without drive.

11 Claims, 5 Drawing Sheets

ROLL STAND WITHOUT HOUSINGS

BACKGROUND OF THE INVENTION

1. Field of the Invention

The present invention relates to a roll stand without roll housings. The roll stand has at least two work rolls which are mounted in roll bearings and which each extend along a roll axis, wherein the rolls define a roll gap and the roll axes define a roll plane, so that the roll plane contains both roll axes, wherein the roll bearings are connected to each other through two groups of connecting elements, wherein one group of connecting elements each is arranged on each side of the roll plane, wherein the connecting elements of the groups are adjustable over an adjusting length distance, wherein at least one of the groups is adjustable under load by means of an adjustment drive in the adjusting direction over an under-load length distance and wherein the under-load length distance is substantially smaller than the adjusting length distance.

2. Description of the Related Art

Roll stands of the above-described type are known in the art. In the roll stands without housings according to the prior art, the connecting elements are adjustable by means of adjusting members provided for the roll stand over the entire adjusting length distance. This adjustability is required to be able to carry out reassembly operations at the roll stand, for example, a roll exchange. During operation, on the other hand, it is merely necessary to be able to adjust the gap—either without load or under load—by a few millimeters.

SUMMARY OF THE INVENTION

Therefore, it is the primary object of the present invention to reduce the cost and the weight of a roll stand while simultaneously not changing the productivity of the roll stand.

In accordance with the present invention, with respect to the portion of the adjusting length distance which exceeds the under-load length distance, the groups of connecting elements are constructed so as to be without drive.

The present invention is based on the finding that the adjustment of the entire adjusting length distance of each connecting element can be carried out by a separate tool which can be placed on the roll stand. This adjusting tool is then only required once for several roll stands, so that, because the roll stands do not have an adjustment drive for the entire adjustment length distance, the individual roll stand has a lighter weight, and a group of, for example, five or ten roll stands with only a single common adjusting tool for the entire group of roll stand is less expensive than providing each roll stand of the group with its own adjusting drive for the entire adjusting length distance.

The other of the groups of connecting elements may also be adjustable by means of an additional adjusting drive over the under-load length distance—either without load or under load. However, the roll stand is even lighter and less expensive if the other of the groups is constructed entirely without drives. Particularly in this last case, for adjusting the roll gap under load, only one group of connecting elements is adjusted while the other group remains unadjusted.

The adjusting drive for adjusting the connecting elements under load can be constructed optionally as a hydraulic cylinder unit or as an electric motor. If the adjusting drive is an electric motor, a single motor, possibly with the use of gear units, can adjust a group of connecting elements.

The present invention is further directed to an adjusting tool to be placed on a roll stand without housings, wherein the adjusting tool is provided for the simultaneous adjustment of all connecting elements of the roll stand with a driven adjusting member for each connecting element, wherein the adjusting members are capable of adjusting the connecting elements of the roll stand over their entire adjusting length distances.

The adjusting tool is structurally particularly simple if the adjusting members are rigidly coupled to each other and a common drive is provided for the adjusting members, wherein the common drive preferably is an electric motor.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
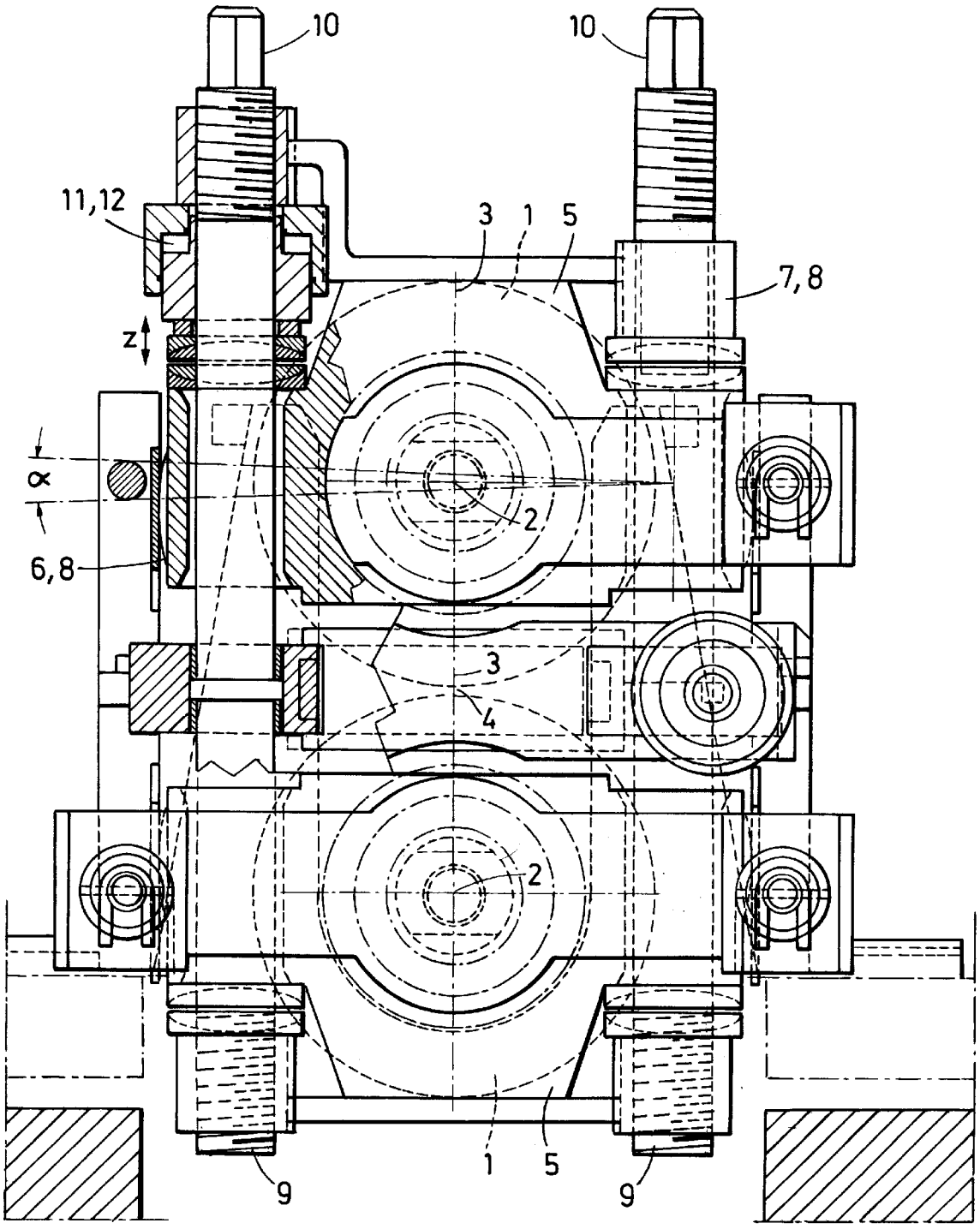
FIG. 1 is a schematic side view of a combination roll stand without housings.
Figure 2:
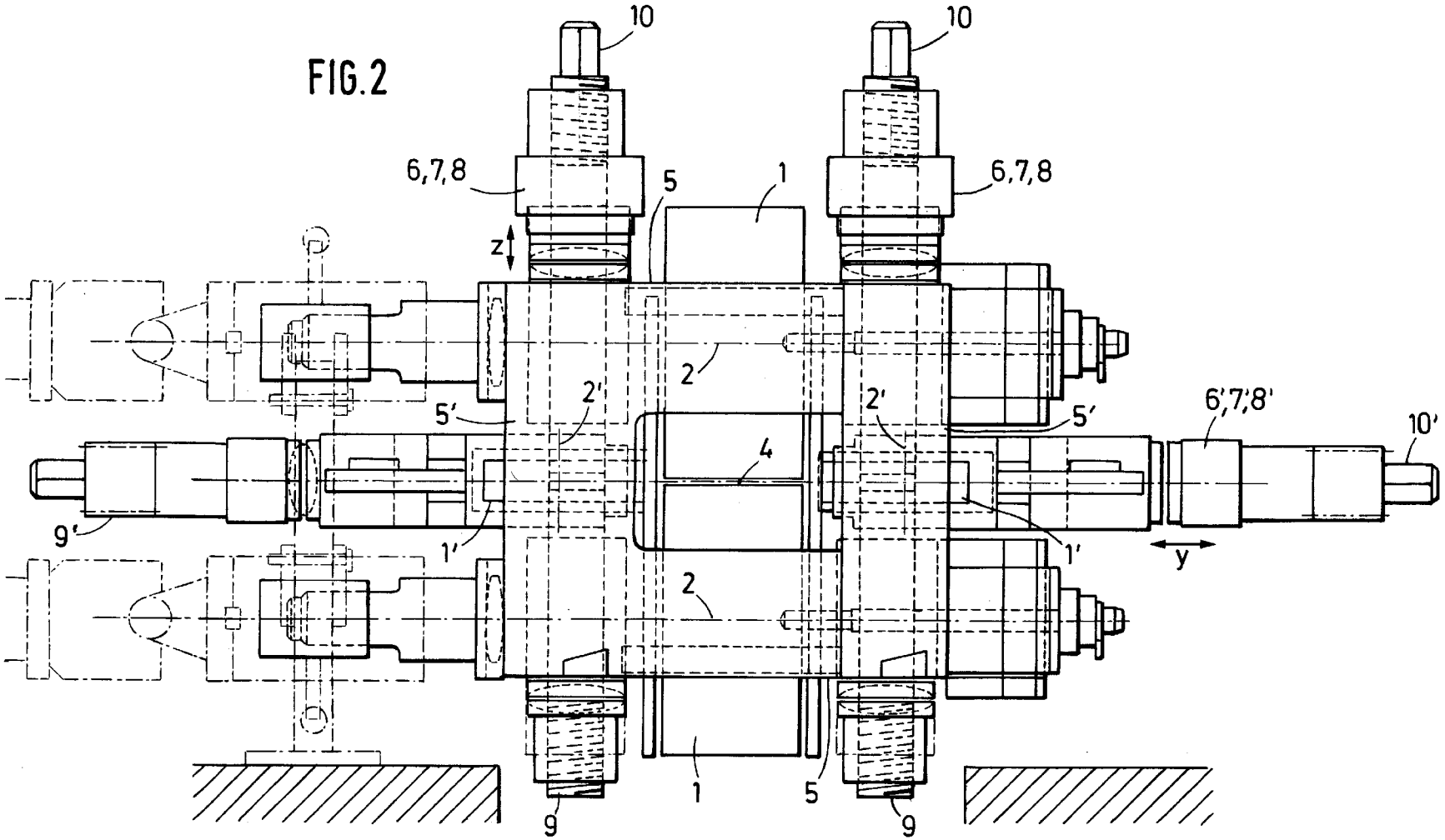
FIG. 2 is a front view of the roll stand of FIG. 1.
Figure 3:
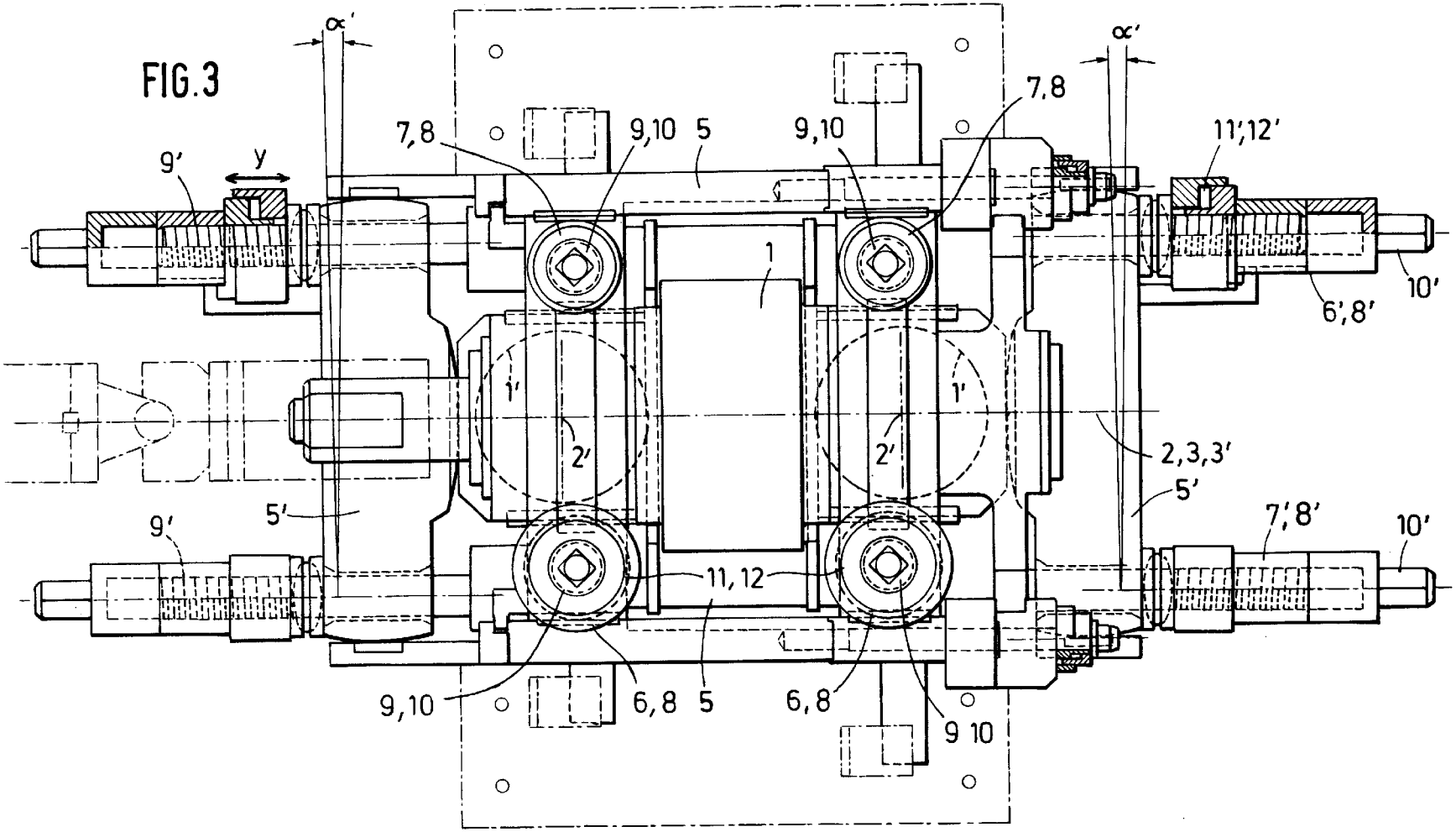
FIG. 3 is a top view of the roll stand of FIG. 1.

As illustrated in FIGS. 1 to 3, a combination roll stand without housings has two rolls 1 for rolling billets or the like, wherein the rolls 1 extend along horizontal roll axes 2. The roll axes 2 extend parallel to each other and define a roll plane 3 as a result. Within the roll plane 3, the rolls 1 define a roll gap 4.

The rolls 1 are supported in roll bearings 5 which are connected to each other to two groups 6, 7 of connecting elements 8. As shown in the drawing the groups 6, 7 are arranged one on each side of the roll plane 3. The connecting elements 8 are provided in the area of the roll bearings 5 with threaded spindles 9 which work in opposite directions. By rotating the connecting elements 8, the connecting elements 8 and, thus, the groups 6, 7 of connecting elements 8, are adjustable in an adjusting direction z over an adjusting length distance of, for example, 40 cm. The connecting elements 8 are provided at their upper ends 10 with square profiles which can be adjusted by means of an adjusting tool which will be described in detail below. However, the connecting elements 8 themselves are constructed so as to be without drives.

During operation of the roll stand, an adjustment of the roll gap 4 by a few millimeters, for example, 5 mm, may be necessary. It must be possible to carry out this adjustment under load. In order to effect the adjustment, one group 6 of the connecting elements 8 is provided with an adjusting drive 11. In the illustrated embodiment, the adjusting drive 11 is comprised of two hydraulic cylinder units 12, wherein each connecting element 8 of the group 6 is provided with its own hydraulic cylinder unit 12. Alternatively, the adjustment could also be effected by electric motors. An adjustment by means of electric motors would have the advantage that both connecting elements 8 of the group 6 could be adjusted synchronously by a common electric motor.

In the illustrated embodiment, the other group 7 of connecting elements 8 is constructed so as to be completely without drives. Consequently, the adjustment of the roll gap 4 under load can only be effected by adjusting one group 6 of connecting elements 8, while the other group 7 of connecting elements 8 remains unadjusted. On the other hand, it would also be possible to provide the other group 7 of connecting elements 8 with hydraulic adjusting drives or adjusting drives in the form of electric motors, so that, in that case, the other group 7 could also be adjusted under load over the under-load length distance.

The connecting elements 8 of the group 6 of the elements is adjustable by the hydraulic cylinder units 12 over an under-load length distance, for example, 10 mm. Consequently, because of the symmetrical arrangement of the groups 6, 7 to the left and right of the roll gap 4, this roll gap 4 can be adjusted by half of the distance of 10 mm, i.e., by 5 mm. This is sufficient for the proper operation of the roll stand. In effect, by adjusting the hydraulic cylinder units 12, the roll stand is adjusted over an angle range $\alpha$ which leads to an adjustment of the roll gap 4. Accordingly, the fine adjustment of the roll gap 4 is carried out in accordance with the unilateral adjusting principle of a swing. The roll gap 4 is changed by the unilateral hydraulic adjustment of one group 6, while the other group 7 is slightly tilted. The magnitude of the adjusting angle $\alpha$ permits an alignment within the stated range of 5 mm or 10 mm, respectively.

Figure 4:
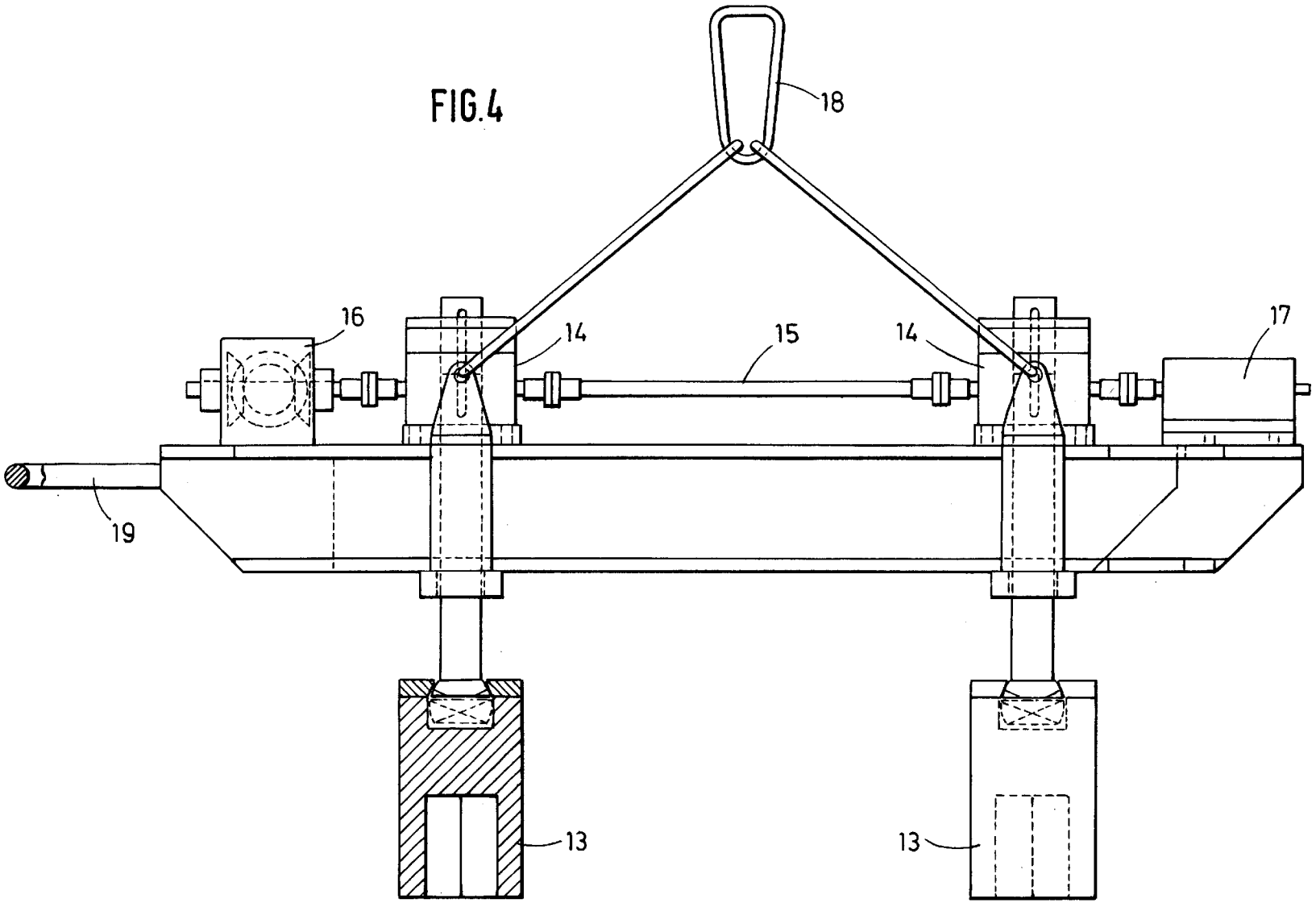
FIG. 4 is a side view of an adjusting tool for the roll stand.
Figure 5:
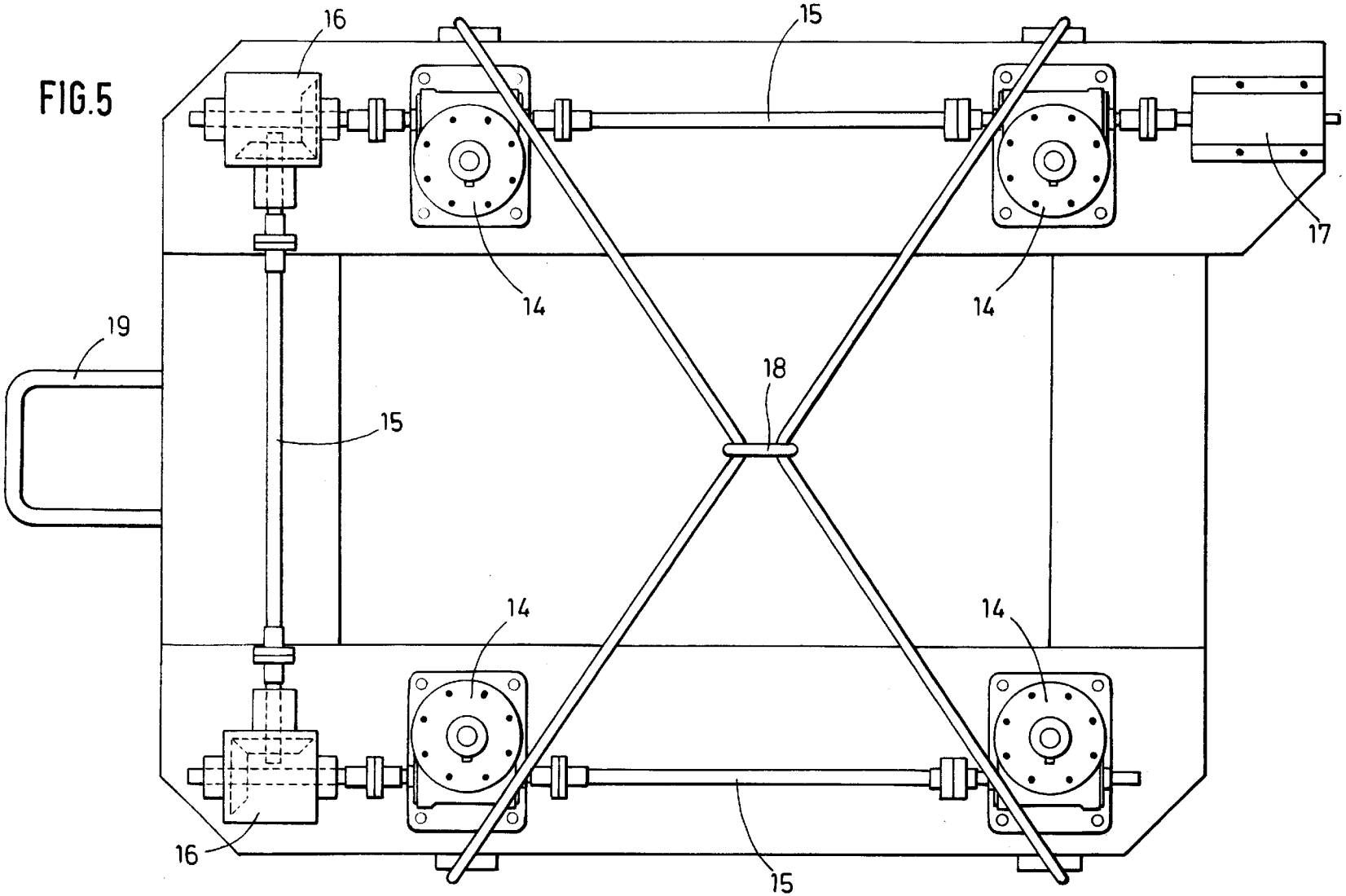
FIG. 5 is a top view of the adjusting tool of FIG. 4.

The adjustment over the entire adjusting length distance, on the other hand, takes place by means of the adjusting tool illustrated in FIGS. 4 and 5. The adjusting tool has four adjusting members 13 by means of which the adjusting tool can be placed on the square profiles at the upper ends 10 of the connecting elements 8. The adjusting members 13 have worm gear units 14 through which the adjusting members 13 are driven by an electric motor 17 through a common shaft 15 and spur gear units 16. As can be seen particularly in FIG. 5, the adjusting members 13 are rigidly coupled to each other through the shaft 15 and the spur gear units 16. Thus, the adjusting members 13 are driven by a common drive 17 for all adjusting members 13. Consequently, a geared synchronous adjustment of the connecting elements 8 takes place.

For placing the adjusting tool on the roll stand, the adjusting tool suspended from an eye hook 18 is supported by means of a crane, not shown, and is lowered onto the roll stand. By means of a handle 19, an alignment of the adjusting tool can be carried out when it is lowered onto the roll stand.

Of course, the placement of the adjusting tool onto the roll stand is independent of the location of the roll stand. Accordingly, the roll stand may be located optionally in the rolling train or outside of the rolling train, for example, in an area where roll stands are reassembled.

Alternatively, the adjusting tool can also be constructed so as to be stationary. In that case, the roll stand is placed onto the adjusting tool, for example, by means of a crane.

The adjustment of the roll stand with respect to its horizontally arranged rolls 1 has been described hereinabove. However, in accordance with the illustrated embodiment particularly illustrated in FIGS. 2 and 3, the roll stand also has two rolls 1' with vertical roll axes 2'. The construction, the bearings, the adjustment, including adjustments under load, etc., are completely analogous. Therefore, corresponding elements provided for the rolls 1' have the same reference numerals as the elements provided for the rolls 1. The elements for the rolls 1' are merely provided with an apostrophe to distinguish them. The only difference which should be mentioned is that only one connecting element 8' is provided for each group 6', 7' of connecting elements 8'. The adjusting direction of these work rolls is denoted by y in FIGS. 2 and 3.

While specific embodiments of the invention have been shown and described in detail to illustrate the inventive principles, it will be understood that the invention may be embodied otherwise without departing from such principles.

We claim:

1. A roll stand without housings, the roll stand comprising at least two work rolls mounted in roll bearings, each work roll extending along a roll axis, wherein the work rolls define a roll gap and the roll axes define a roll plane so that the roll plane includes both roll axes, further comprising first and second groups of connecting elements for connecting the roll bearings, wherein the first group is arranged on one side of the roll plane and the second group is arranged on another side of the roll plane, wherein the connecting elements of the first and second groups of adjusting elements are adjustable in an adjusting direction over an adjusting length distance, wherein at least the first group is adjustable under load by an adjusting drive in the adjusting direction over an under-load length distance, wherein the under-load length distance is substantially smaller than the adjusting length distance, and, wherein, with respect to a portion of the adjusting length distance exceeding the under-load length distance, the first and second groups of connecting elements are constructed so as to be without drives.

2. The roll stand according to claim 1, wherein the connecting elements of the second group are constructed so as to be entirely without drives.

3. The roll stand according to claim 1, wherein the adjusting elements of the second group are adjustable under load over the under-load length distance.

4. The roll stand according to claim 1, wherein each adjusting drive is constructed as a hydraulic cylinder unit.

5. The roll stand according to claim 1, wherein each adjusting drive is an electric motor.

6. An adjusting tool adapted for placement on a roll stand without housings, the roll stand including at least two work rolls mounted in roll bearings, each work roll extending along a roll axis, wherein the work rolls define a roll gap and the roll axes define a roll plane so that the roll plane includes both roll axes, further including first and second groups of connecting elements for connecting the roll bearings, wherein the first group is arranged on one side of the roll plane and the second group is arranged on another side of the roll plane, wherein the adjusting elements of the first and second groups of connecting elements are adjustable in an adjusting direction over an connecting length distance, wherein at least the first group is adjustable under load by an adjusting drive in the adjusting direction over an under-load length distance, wherein the under-load length distance is substantially smaller than the adjusting length distance, and, wherein, with respect to a portion of the adjusting length distance exceeding the under-load length distance, the first and second groups of adjusting elements are constructed so as to be without drives, the connecting tool comprising for each connecting element for the roll stand a driven adjusting member for simultaneously adjusting all connecting elements of the roll stand, such that the connecting elements of the roll stand are adjustable over the entire adjusting distance length by the adjusting members.

7. The adjusting tool according to claim 6, further comprising a common drive for the adjusting members.

8. The adjusting tool according to claim 6, wherein the adjusting members are rigidly coupled to each other.

9. The adjusting tool according to claim 7, wherein the drive is an electric motor.

10. A method of operating a roll stand without housings, the roll stand including at least two work rolls mounted in roll bearings, each work roll extending along a roll axis, wherein the work rolls define a roll gap and the roll axes define a roll plane so that the roll plane includes both roll axes, further including first and second groups of connecting elements for connecting the roll bearings, wherein the first group is arranged on one side of the roll plane and the second group is arranged on another side of the roll plane, wherein the connecting elements of the first and second groups of connecting elements are adjustable in an adjusting direction over an adjusting length distance, wherein the first group is adjustable under load by an adjusting drive in the adjusting direction over an under-load length distance, wherein the under-load length distance is substantially smaller than the adjusting length distance, and, wherein, with respect to a portion of the adjusting length distance exceeding the under-load length distance, the first and second groups of connecting elements are constructed so as to be without drives, the method comprising, for adjusting the roll gap, adjusting the connecting elements of the first and second groups of connecting elements over the adjusting length distance, and, for adjusting the roll gap under load, adjusting the connecting elements of the first group over the under-load length distance, while leaving the connecting elements of the second group unadjusted.

11. The method according to claim 1, comprising adjusting the first group of adjusting elements under load by a single adjusting drive.

* * * * *